US011890718B2

(12) United States Patent
Han et al.

(10) Patent No.: US 11,890,718 B2
(45) Date of Patent: Feb. 6, 2024

(54) REMOVABLE TRAY ASSEMBLY FOR CMP SYSTEMS

(71) Applicant: Taiwan Semiconductor Manufacturing Co., Ltd., Hsinchu (TW)

(72) Inventors: Yu-Feng Han, Hsinchu (TW); A. S. Chen, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 794 days.

(21) Appl. No.: 16/746,609

(22) Filed: Jan. 17, 2020

(65) Prior Publication Data

US 2021/0220961 A1 Jul. 22, 2021

(51) Int. Cl.
*B24B 37/04* (2012.01)

(52) U.S. Cl.
CPC ..... *B24B 37/04* (2013.01)

(58) Field of Classification Search
None
See application file for complete search history.

(56) References Cited

U.S. PATENT DOCUMENTS 5,738,574 A * 4/1998 Tolles ..... B24B 53/017 451/247
5,762,544 A * 6/1998 Zuniga ..... B24B 37/30 451/285
5,804,507 A * 9/1998 Perlov ..... B24B 37/04 438/692
5,993,302 A * 11/1999 Chen ..... B24B 37/32 451/41
6,358,116 B1 * 3/2002 Strother ..... B24B 37/0053 451/36
7,252,099 B2 * 8/2007 Chen ..... H01L 21/67051 134/198

(Continued)

FOREIGN PATENT DOCUMENTS

CN 1618569 A 5/2005
CN 1653211 A * 8/2005 ..... C25D 17/001

(Continued)

OTHER PUBLICATIONS

Machine Generated English Translation of the claims of JP2007-314210. Published Dec. 6, 2002. (Year: 2007).*

*Primary Examiner* — Sylvia MacArthur
(74) *Attorney, Agent, or Firm* — Seed IP Law Group LLP

(57) ABSTRACT

The present disclosure provides a tray assembly having a dual-structure. The tray assembly comprises an upper tray and a lower tray. The lower tray is capable of being easily disengaged from the upper tray by use of a dovetail joint that allows the lower tray to slidably move relative to the upper tray. The tray assembly also utilizes magnets to reduce the use of mechanical joints. The combination of the magnets together with the dovetail joint provides a quick and efficient way of sliding the lower tray in and out from the upper tray. The lower tray having a collection region collects any external, foreign materials generated during a chemical mechanical polishing/planarizing process. After the cleaning process, the lower tray can be slid back into the upper tray for use.

20 Claims, 12 Drawing Sheets

(56) References Cited

U.S. PATENT DOCUMENTS

| | | | | |
|---|---|---|---|---|
| 8,795,032 | B2 * | 8/2014 | Miyazaki | H01L 21/67742 451/442 |
| 8,801,506 | B2 * | 8/2014 | Chen | B24B 55/06 451/359 |
| 2006/0070872 | A1 * | 4/2006 | Mavliev | B24B 37/22 204/224 R |
| 2008/0202568 | A1 | 8/2008 | Benner | |
| 2021/0220961 | A1 * | 7/2021 | Han | B24B 37/04 |

FOREIGN PATENT DOCUMENTS

| | | | |
|---|---|---|---|
| CN | 1835824 | A | 9/2006 |
| CN | 102310358 | A | 1/2012 |
| JP | 2007314210 | A * | 12/2007 |
| TW | 383259 | B | 3/2000 |
| TW | 200605216 | A | 2/2006 |

* cited by examiner

REMOVABLE TRAY ASSEMBLY FOR CMP SYSTEMS

BACKGROUND

Chemical mechanical polishing or chemical mechanical planarization (CMP) is an important step in semiconductor manufacturing. CMP utilizes the combined effects of chemical and mechanical interactions for polishing/planarizing surfaces. That is, CMP is used to achieve a substantially planar and smooth surface of a material layer or layers, such as semiconductor, dielectric and metallization layers on a workpiece, such as a semiconductor wafer. When the purpose is to remove surface materials, it is referred to as chemical mechanical polishing. On the other hand, when the purpose is to flatten a surface, it is referred to as chemical mechanical planarization. This manufacturing process is used to fabricate, for example, integrated circuits, microprocessors, memory chips or the like.

During the CMP process, a tray assembly located above a polishing head (e.g., part of a CMP device used for polishing a workpiece that is underneath the polishing head) collects unwanted foreign particles or materials (e.g., metal scraps, debris, slurries, etc.). The tray assembly requires cleaning after numerous uses of the CMP device. Frequent removal of metal scraps, debris or slurry (typically a colloid having abrasive and corrosive features) or other foreign materials that have collected on the tray assembly is a best practice in order to maintain a clean environment during the CMP process.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
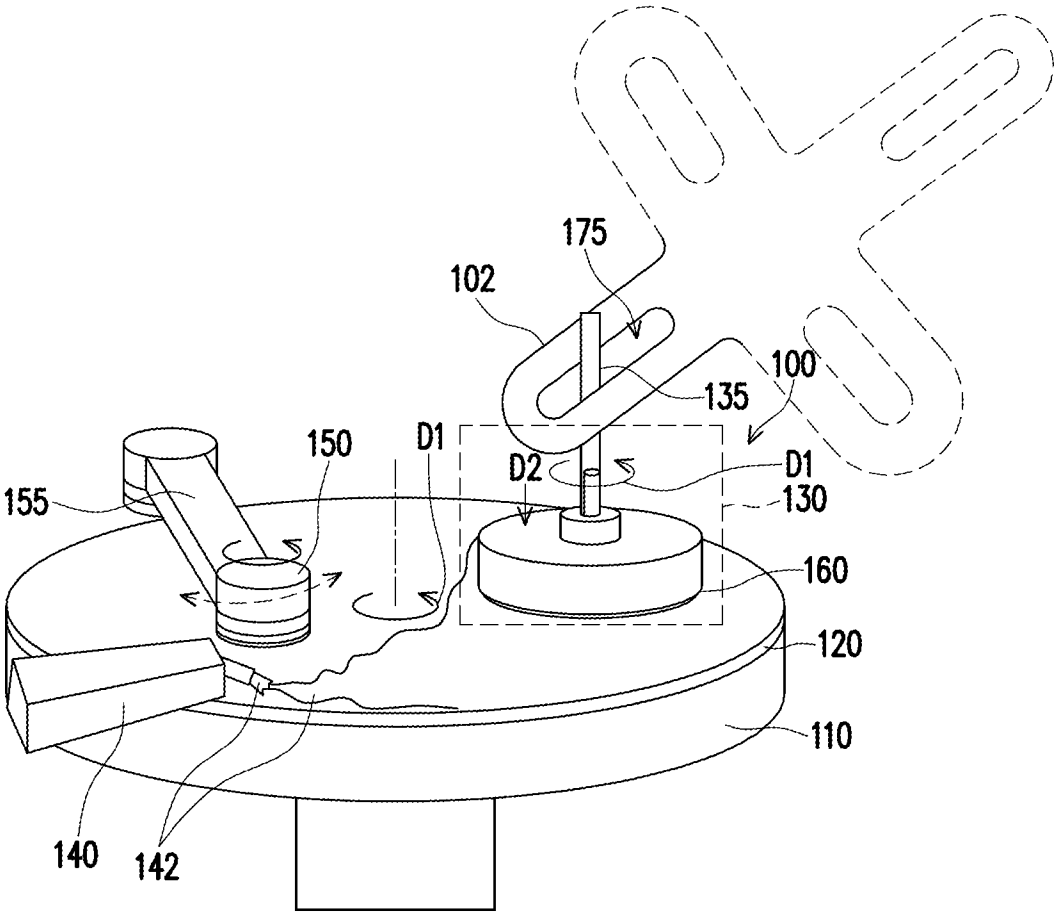
FIG. 1A schematically illustrates a perspective view of a portion of a CMP system according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly.

FIG. 1A schematically illustrates a perspective view of a portion of a CMP device or system 100 according to one embodiment of the present disclosure. As shown in FIG. 1, CMP system 100 includes a platen 110, a polishing pad 120, a polishing head 130, an arm 135 attached to the polishing head 130, a slurry dispenser 140, and a pad conditioner 155 having a disk 150. The polishing pad 120 is arranged on the platen 110. The slurry dispenser 140, the polishing head 130, and the pad conditioner 155 are present above the polishing pad 120. The platen 110 has a circular shape.

The polishing pad 120 is formed of a material that is hard enough to allow the abrasive particles in the slurry 142 to mechanically polish a workpiece 160, such as a wafer, which is between the polishing head 130 and the polishing pad 120. The following description refers to a wafer as one example of workpiece 160; however, the present disclosure is not limited to workpieces that are wafers. On the other hand, polishing pad 120 is soft enough so that it does not substantially scratch or otherwise damage the wafer 160 during the polishing process.

During the CMP process, the platen 110 is supported by a bearing (not shown) that is located beneath the platen 110. The platen 110 and the bearing connected together, cooperate with a mechanism, such as a motor or a drive (not shown), and rotate the polishing pad 120 in a direction D1 around an axis. As the platen 110 and polishing pad 120 are rotating, the polishing head 130 biases the wafer 160 in a direction D2 so that a surface of the wafer 160 is pushed against the polishing pad 120, such that the surface of the wafer 160 in contact with the polishing pad 120 is polished by the slurry 142.

In accordance with embodiments of the present disclosure, the polishing head 130 rotates (e.g., in the direction D1, as shown or the reverse direction), causing the wafer 160 to rotate around an axis of the polishing head 130, and move on the polishing pad 120 at the same time; however, various embodiments of the present disclosure are not limited in this way. In some embodiments of the present disclosure, as shown in FIG. 1A, the polishing head 130 and the polishing pad 120 rotate in the same direction (e.g., clockwise or counter-clockwise). In alternative embodiments, the polishing head 130 and the polishing pad 120 rotate in opposite directions.

While the CMP system 100 is in operation, the slurry 142 flows between the wafer 160 and the polishing pad 120. The slurry dispenser 140, which has an outlet over the polishing pad 120, is used to dispense slurry 142 onto the polishing pad 120. In some embodiments, the slurry dispenser 140 may dispense other chemical materials suitable for polishing or planarizing the wafer 160. For example, the slurry dispenser 140 may dispense deionized water (DIW). The material dispensed by the slurry dispenser 140 is not limited to slurries or DIW. The slurry 142 includes reactive chemical(s) that react with the surface layer of the wafer 160 and abrasive particles for mechanically polishing the surface of the wafer 160. Through the chemical reaction between the reactive chemical(s) in the slurry 142, the surface layer of wafer 160, and the mechanical polishing, the surface layer of wafer 160 is removed.

As the polishing pad 120 is used, the polishing surface of the polishing pad 120 tends to glaze, reducing the removal rate and overall efficiency. The disk 150 of the pad conditioner 155 is arranged over the polishing pad 120, and is configured to be used to condition the polishing pad 120, e.g., by removing undesirable by-products generated during the CMP process. The disk 150 generally has protrusions or cutting edges that can be used to polish and re-texturize the surface of the polishing pad 120 during a dressing or conditioning process. In some embodiments of the present disclosure, the disk 150 contacts the top surface of the polishing pad 120 when the polishing pad 120 is to be conditioned. During the conditioning process, the polishing pad 120 and the disk 150 are rotated, so that the protrusions or cutting edges of the disk 150 move relative to the surface of the polishing pad 120, thereby polishing and re-texturizing the surface of the polishing pad 120.

As shown in FIG. 1A, a tray assembly 102 is overlain on above of the polishing head 130. The tray assembly 102 includes an opening 175 for an arm 135 to pass through the tray assembly 102. The arm 135 may be connected to other parts of the CMP system 100, e.g., a drive mechanism for rotating polishing head 130 via rotation of arm 135.

The tray assembly 102 is located above the polishing head 130 so that unwanted or unnecessary particles or materials (e.g., industrial dust, metal particles, chemical/mechanical substances, impurities, debris, slurries, or other materials) present in the manufacturing environment are prevented from falling on top of, or otherwise collecting on, the polishing head 130 and the polishing pad 120. In the discussion that follows these unwanted or unnecessary particles or materials are collectively referred to as "particles" even though some of the materials may not be in particulate form. If these particles are allowed to collect on the polishing pad 120, they can negatively affect the CMP process, e.g., by damaging the surface of the workpiece 160 and/or forming an irregular surface on the workpiece. In one embodiment, the size and dimension (e.g., length, width, height, etc.) of the tray assembly 102 is large enough to entirely cover the polishing head 130 and the workpiece 160 located beneath it. When the tray assembly 102 is of such size, except for particles that might pass through the space 175 in the tray assembly 102, the tray assembly 102 effectively shields the top of the polishing head 130 and the polishing pad 120 from particles that may originate from above the tray assembly 102 or particles that do not originate from above the tray assembly 102. In addition, the tray assembly 102 can shield the top of the polishing head from slurries that might splash up from the surface of the polishing pad and otherwise land on top of the polishing head 130. For example, when dispensing slurries onto a rotating polishing pad 120, portions of the slurries that splash upwards from the polishing pad 120 toward the top of the polishing head 130 will be captured by the tray assembly 102 before such portion of the slurries reach the top of polishing head 130. In other embodiments, the tray assembly 102 has a size and/or shape different than that described above and illustrated in FIG. 1A. For example, in accordance with other embodiments of the present disclosure, the size and shape of the tray assembly 102 does not depend on the size of the polishing head 130 or the polishing pad 120. Details of the tray assembly 102 are explained with reference to the following figures.

Figure 1B:
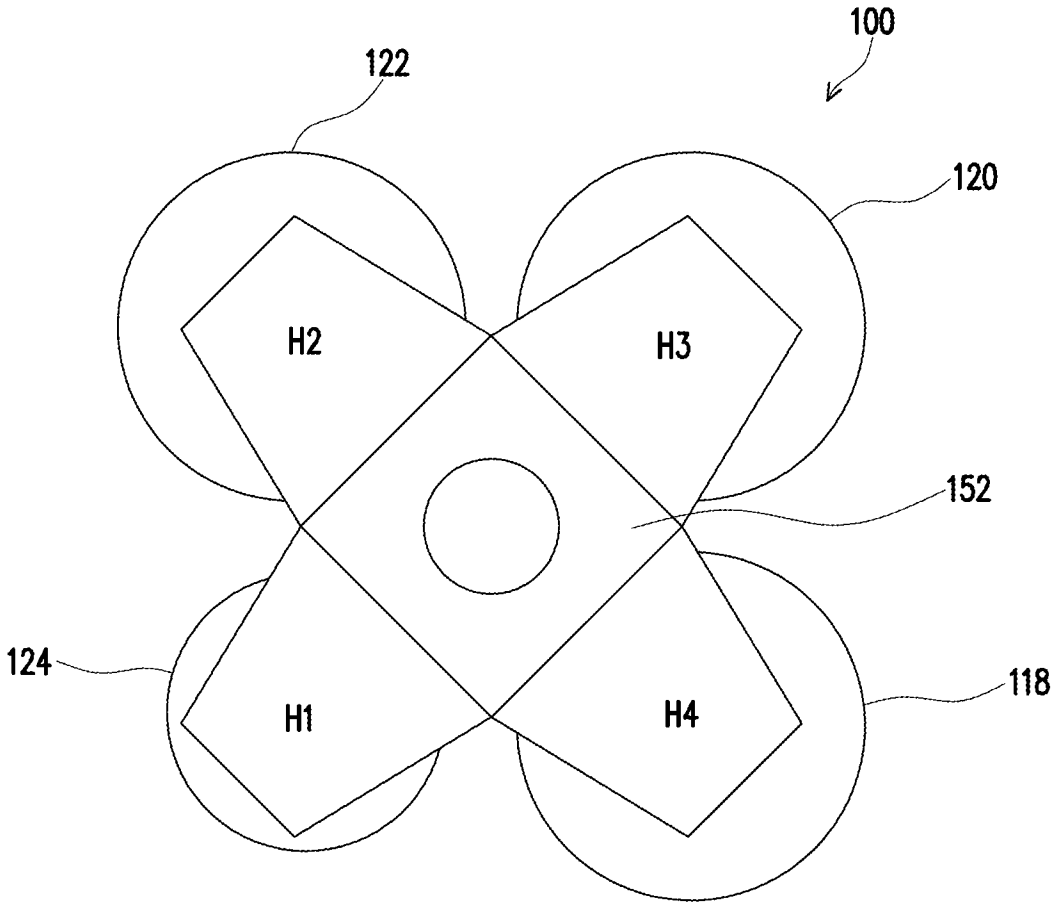
FIG. 1B is a top view of a portion of a CMP system.

FIG. 1B is a top view of a portion of a CMP system 100. In FIG. 1B, a tray assembly 102 according to embodiments of the present disclosure shown in FIG. 1A is not visible in FIG. 1B because it is below the head H3 of the CMP system 100. In accordance with embodiments of the present disclosure, similar tray assemblies are located under heads H1, H2, H4. Each head performs various steps of the CMP process. For example, the CMP system 100 can be designed so that certain CMP process steps are be performed concurrently under more than one head. For example, planarizing a metal layer of workpieces can be performed under heads H2, H3, and H4 at the same time. Thereafter, the load/unload station 124 may move the workpieces to another part of the CMP system 100 so that the workpiece may undergo different manufacturing procedures. On the other hand, the CMP system 100 can be designed so that different processes are performed sequentially under different heads to minimize the movement of the workpiece to different parts of the CMP system 100. For example, a back grinding of a metal layer of workpieces can be performed under head H2. Once the back grinding process at head H2 is complete, the load/unload station 124 may move the workpiece and place it under head H4 for other processing, and thereafter place it under head H3 for other processing. The heads H1, H2, H3, H4 are attached to a carousel 150 which allows heads H1, H2, H3 and H4 to be rotated around an axis of the carousel. Such rotation supports the movement of the workpieces through various steps of the CMP process.

Figure 2A:
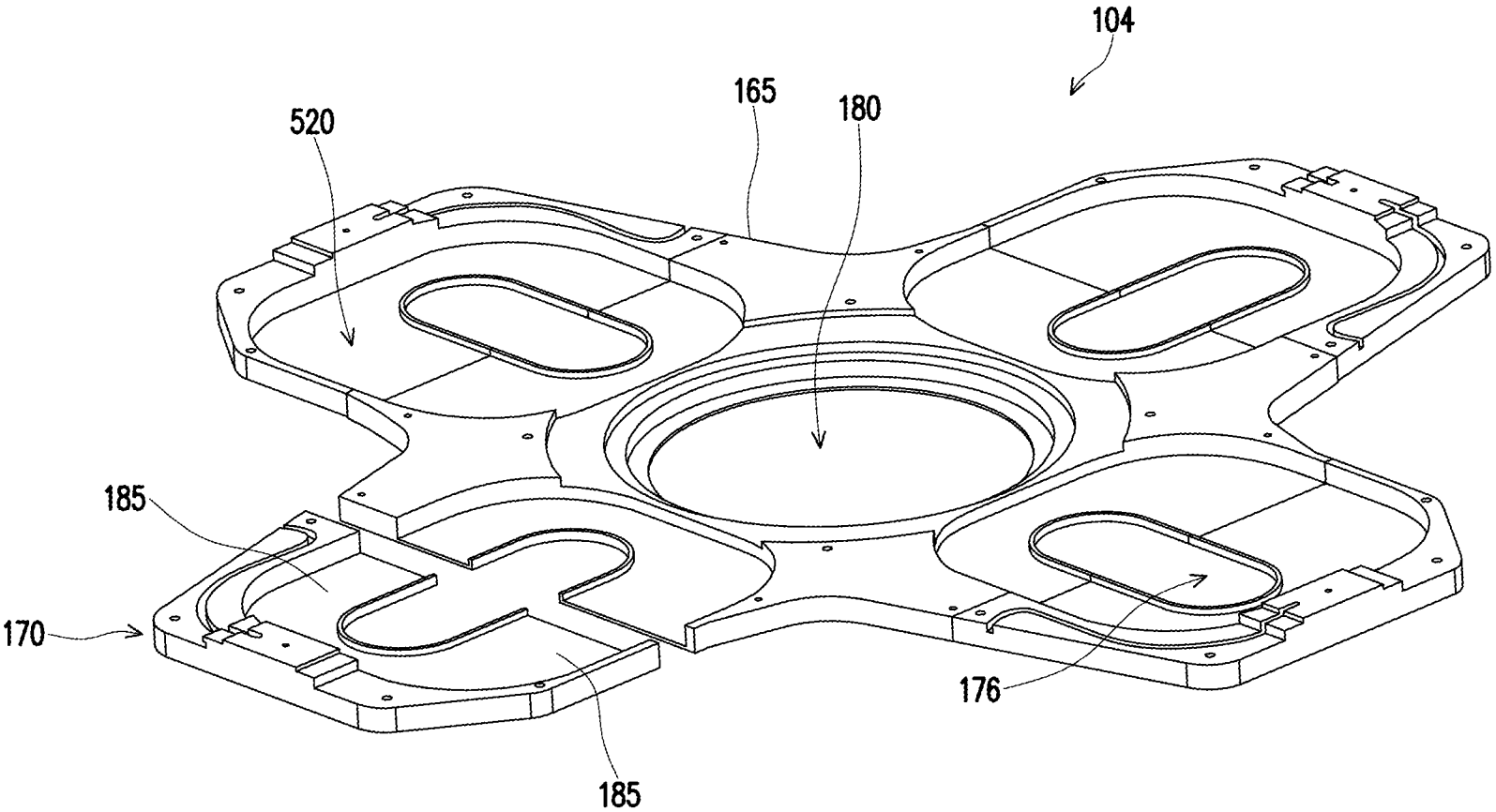
FIG. 2A is a perspective view of a tray that is part of a CMP system of the related art.

FIG. 2A is a perspective view of a tray 104 that is part of a CMP system of the related art. The tray 104 has a different structure compared to the tray assembly 102 according to the present disclosure which will be described in more detail below. The tray 104 of the related art includes a detachable tray portion 170 and a central body portion 180. The detachable tray portion 170 is a single-body or unitary structure. That is, the tray portion 170 cannot be further disassembled which is different from the tray assembly 102 according to the present disclosure. As shown, the tray 104 includes four separate detachable tray portions 170. In operation, these tray structures or tray pieces are removably attached to the central body portion 180. As explained in connection with FIG. 1A, the space 175 between the tray portion 170 and the central body portion 180 is provided for the arm 135 to pass through the tray assembly 104 and maneuver around the space 175. For example, during the polishing or planarization process, arm 135 attached to the polishing head 130 moves within the space 175 during the polishing of workpiece 160 under the polishing head 130. The arm 135 is capable of rotating itself, moving around within the space 175, as well as moving up and down relative to the surface of the polishing pad 120.

In the related art, as shown in FIG. 2A, when the arm 135 moves within opening 176, arm 135 may contact an inner surface 185 of the tray portion 170 which defines opening 176. The arm 135 may also contact an inner surface 185 of a portion of opening 176 that is in the control body portion 180. In this case, the contact between the arm 135 and the inner surfaces 185 of the tray 104 can produce, for example, metal scraps, particles or debris. Use of the CMP system will result in formation of metal particles or debris which then accumulates in a collecting region 520 of the tray 104. The collecting region 520 may also collect other particles or debris that fall on top of the tray 104 from parts of the CMP system 100 located above the tray 104. In addition, splashing of portions of slurries 142 applied to polishing pad 120 results in portions of the slurries ending up on the collecting region 520. The tray portions 170 are detachable from the central body portion 180 of the tray 104 and the particles, slurries, etc., gathered on the collection region 520 can be removed from the collection region 520 and other surfaces of the tray 104. In FIG. 2A, opening 165 in the center of central body portion 180 receives a rotating mechanism (e.g., carousel) which is used to rotate the tray 104 and polishing head 130 to different stages (e.g., different polishing pads) of the CMP process.

Figure 2B:
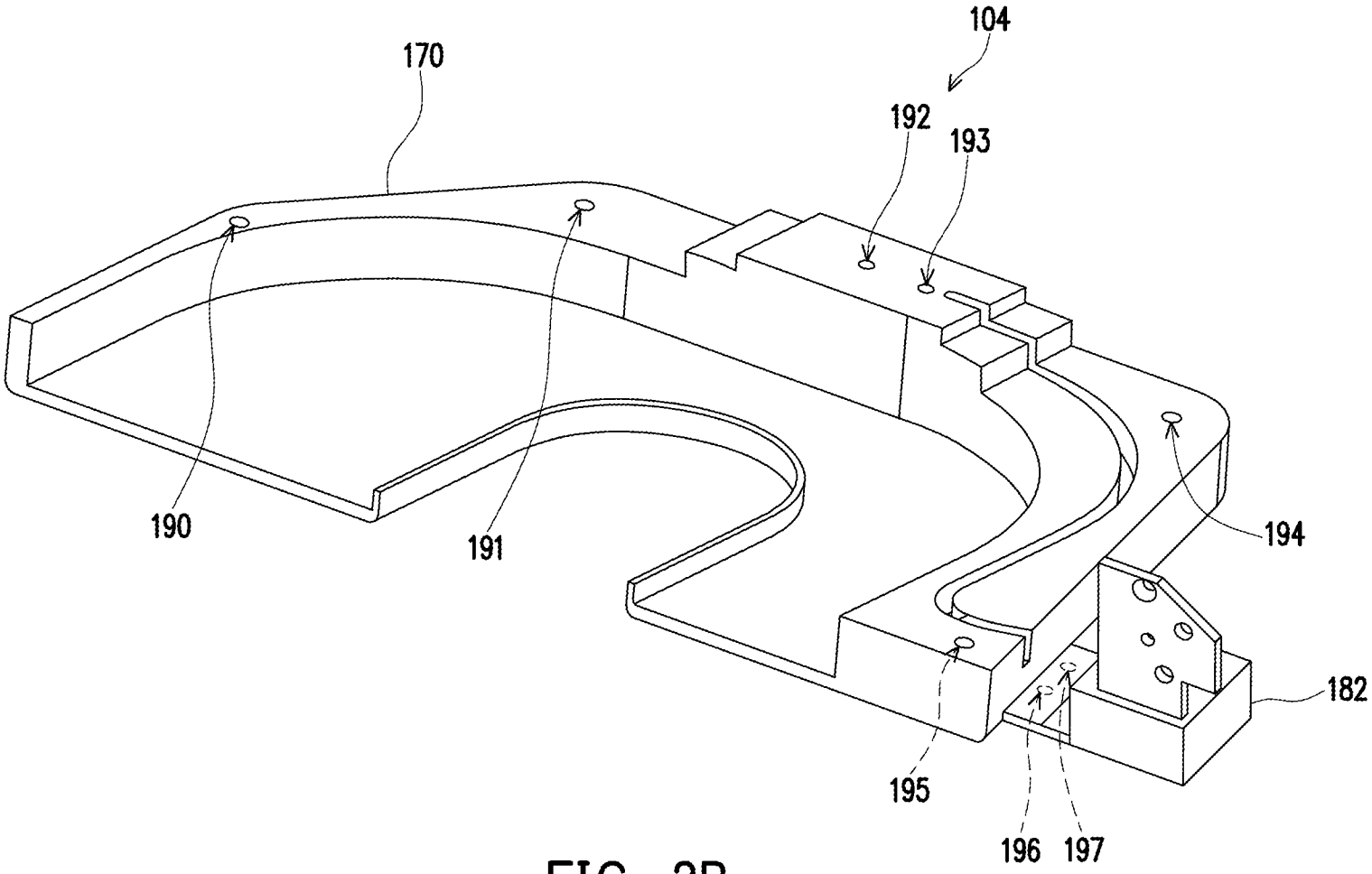
FIG. 2B is a perspective view of a tray portion of the tray in the related art.

FIG. 2B is a perspective view of a tray portion 170 of the tray 104 in the related art. The tray portion 170 includes various holes 190, 191, 192, 193, 194, 195, 196, 197 to receive fasteners, e.g., screws, used to affix a sensor 182 to the tray portion 170 and to affix the tray portion 170 to a part of the CMP system above the tray portion 170. For example, the screws at holes 196, 197 affix the sensor 182 to the tray portion 170. The screws at holes 190, 191, 192, 193, 194, 195 affix the tray portion 170 to the part of the CMP system above the tray portion 170. Accordingly, in the related art, in order to clean the collection region 520 of the tray portion 170, at least the screws placed in the holes 190, 191, 192, 193, 194, 195, 196, 197 must be removed so that the sensor 182 can be removed from the tray portion 170 and the tray portion 170 can removed from portions of the CMP system above the tray portion. This removal of screws, detaching, cleaning and attaching process for the tray portion 170 can involve approximately 100 to 140 minutes of maintenance time due to the time required to remove and reinstall the numerous screws and to clean and reattach the tray portion 170.

The sensor 182 is used to sense whether the workpiece 160 is appropriately attached to the polishing head 130 and whether the workpiece 160 is aligned correctly with the polishing head 130. The sensor 182 can be modified to make other measurements, e.g., detection of irregularities as well. The types of sensors that can be used include, but are not limited to, infrared sensors, laser detectors, or the like. In one embodiment, the sensor 182 may emit light towards the polishing pad 120 contacting the workpiece 160 and receive reflected light from the polishing pad 120 to detect whether the workpiece 160 is correctly aligned and attached with the polishing head 130. For example, if light is reflected from the workpiece 160 rather than the polishing pad 120, a processor of the CMP system connected to the sensor 182 determines that the workpiece 160 is tilted, misplaced, or incorrectly aligned on the polishing head 130. In another embodiment, the sensor 182 may sense the color difference between the polishing pad 120 and the workpiece 160 to determine whether the workpiece 160 is correctly aligned and attached to the polishing head 130. For example, if the sensor 182 detects the color of the workpiece 160 rather than the polishing pad 120, the processor connected to the sensor 182 determines that the workpiece 160 is tilted, misplaced, or otherwise incorrectly attached to the polishing head 130.

Figure 3A:
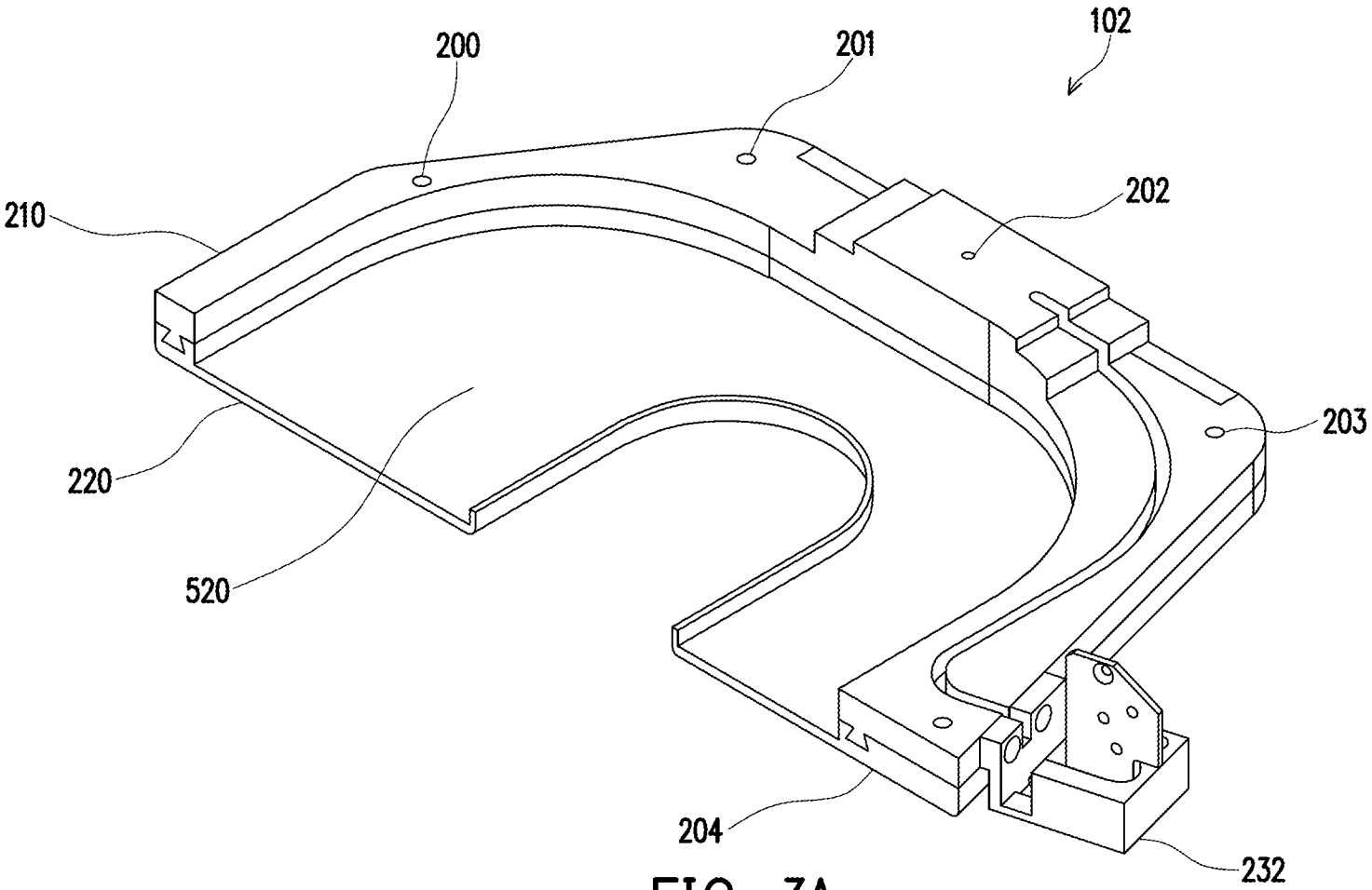
FIG. 3A is a perspective view of an attached state of a removable tray assembly according to one embodiment of the present disclosure.

FIG. 3A is a perspective view of a removable tray assembly 102 according to one embodiment of the present disclosure in an attached state, i.e., an upper tray 210 attached to a lower tray 220. The upper tray 210 has a sensor 232 affixed to one side of the upper tray 210. In contrast to the tray 104 according to the related art, the sensor 232 does not have to be detached from the tray assembly 102 in order to carry out the cleaning process of the tray assembly 102 as described below in more detail. The upper tray 210 further includes holes 200, 201, 202, 203 for receiving fasteners used to attach the tray assembly 102 to parts of the CMP system 100 located above the tray assembly 102. The lower tray 220 includes a collection region 520. When the upper tray 210 and the lower tray 220 are mated and attached to each other, there are no gaps or voids between the upper tray 210 and the lower tray 220. Accordingly, collection of fluids or particles between the upper tray 210 and the lower tray 220 is avoided or minimized. These fluids or particles may include liquids such as DIW, slurries or particles such as metal debris or other materials generated or used in the CMP process.

Figure 3B:
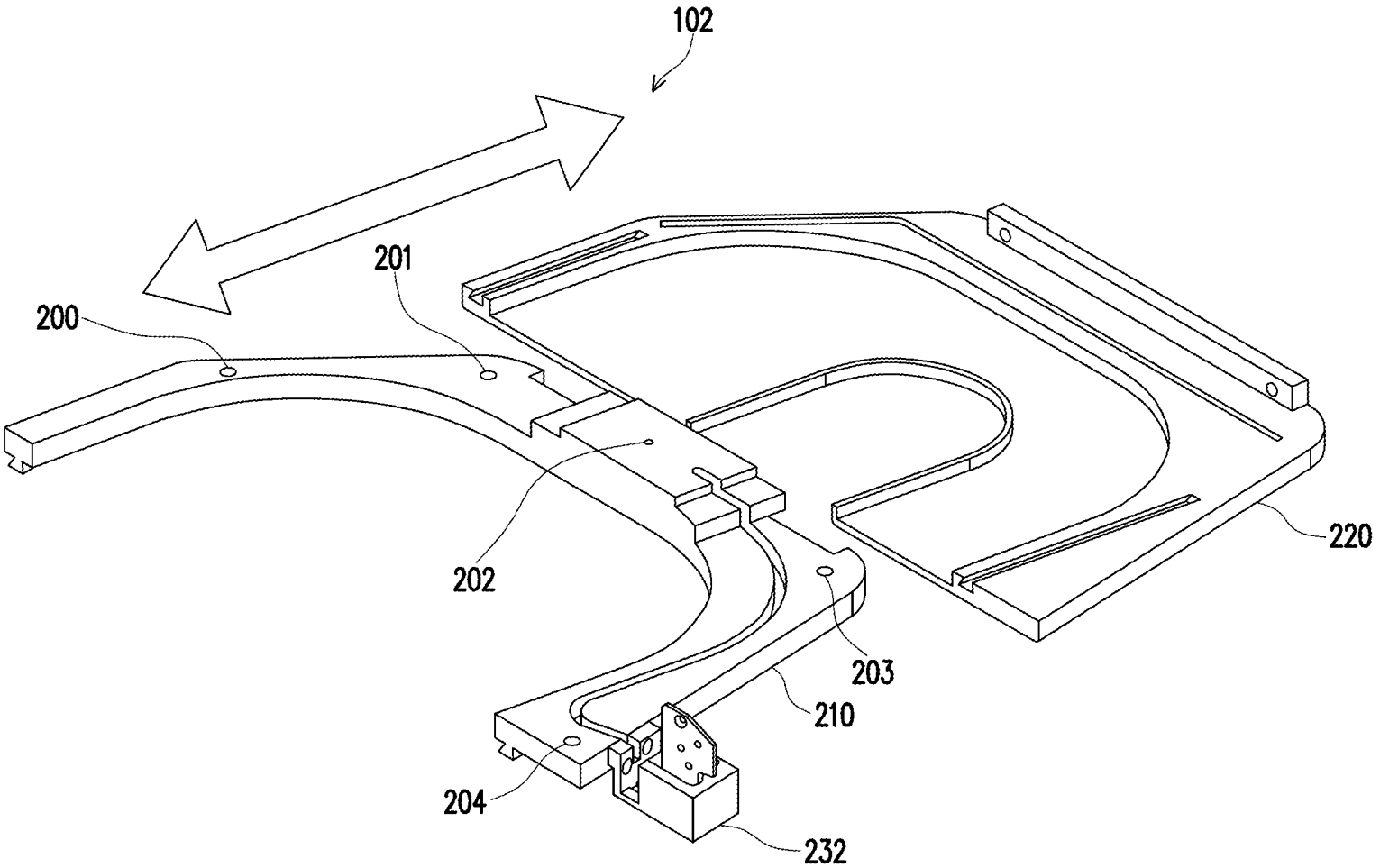
FIG. 3B is a perspective view of a detached state of a removable tray assembly according to one embodiment of the present disclosure.

FIG. 3B is a perspective view of a removable tray assembly 102 according to one embodiment of the present disclosure where the upper tray 210 has been detached from the lower tray 220. As shown, in accordance with embodiments of the present disclosure, the lower tray 220 can be slid out from the upper tray 210 for cleaning. In accordance with embodiments of the present disclosure, the lower tray 220 can be slid out from the upper tray 210 for cleaning without the need to remove fasteners present in sensor 232 and holes 200, 201, 202, 203, 204. In other words, in accordance with embodiments of the present disclosure, the sensor 232 can remain attached to the upper tray 210 when the lower tray 220 is separated from the upper tray 210. In addition, the upper tray 210 can remain attached to other parts of the CMP system 100 located above the tray assembly 102. In accordance with embodiments of the present disclosure, the lower tray 220 including the collection region 520 can be removed from the tray assembly 102 for cleaning with needing to detach the upper tray 210 from portions of the CMP system to which the upper tray is attached. Unlike the tray assembly 104 of the related art which required fasteners in holes 190, 191, 192, 193, 194, 195, 196, 197 to be removed in order to remove sensor 232 from detachable tray 170 and to remove tray assembly 104 from other portions of the CMP system for cleaning, the removable tray assembly 102 according to the present disclosure does not require detaching sensor 232 from upper tray 210 or removing fasteners in holes 200, 201, 202, 203, 204 in order to clean lower tray 220, e.g., collection region 520.

Figure 3C:
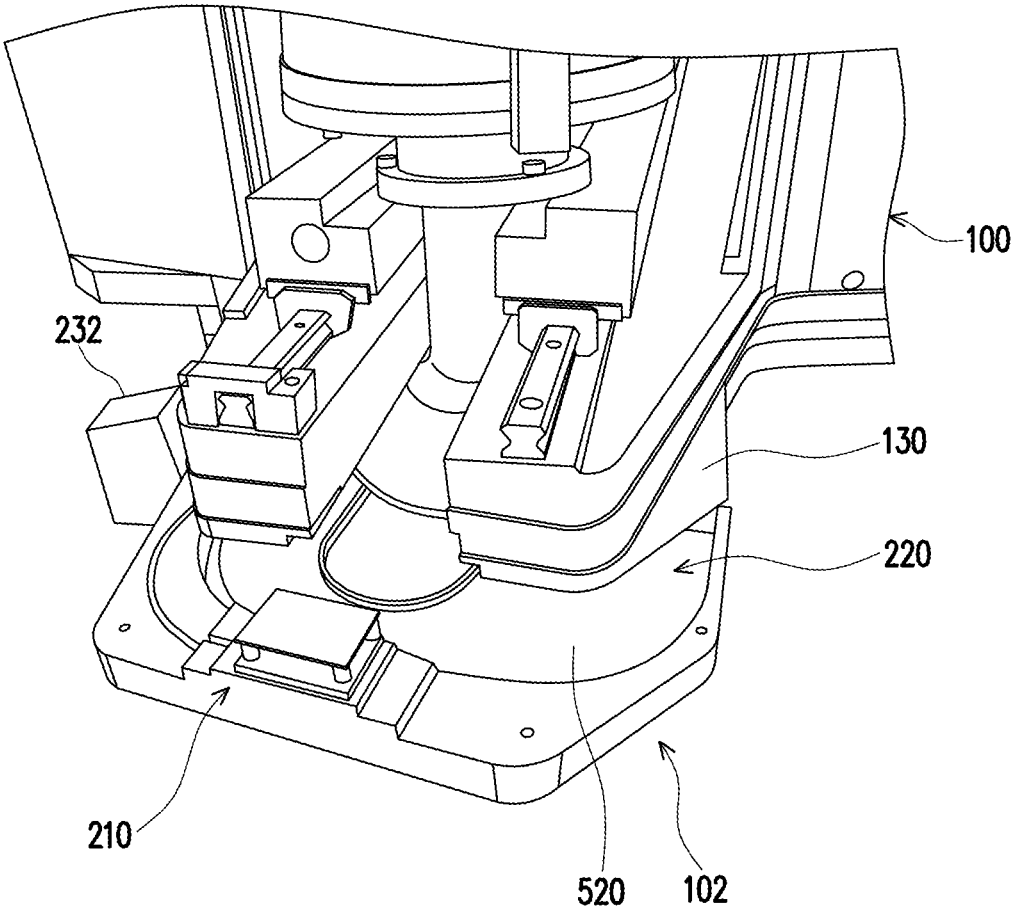
FIG. 3C is a perspective view of a removable tray assembly shown in relation to a polishing head of the CMP system according to one or more embodiments of the present disclosure.

FIG. 3C is a perspective view of a removable tray assembly 102 shown in relation to a polishing head 130 of the CMP system according to one or more embodiments of the present disclosure. As shown, the lower tray 220 can be slid out from the upper tray 210 to remove any external materials collected in the collection region 520. During this cleaning process, as shown in the drawing, the sensor 232 can remain attached to the upper tray 210 when the lower tray 220 is separated from the upper tray 210. In addition, the upper tray 210 can remain attached to other parts of the CMP system 100.

Figure 4:
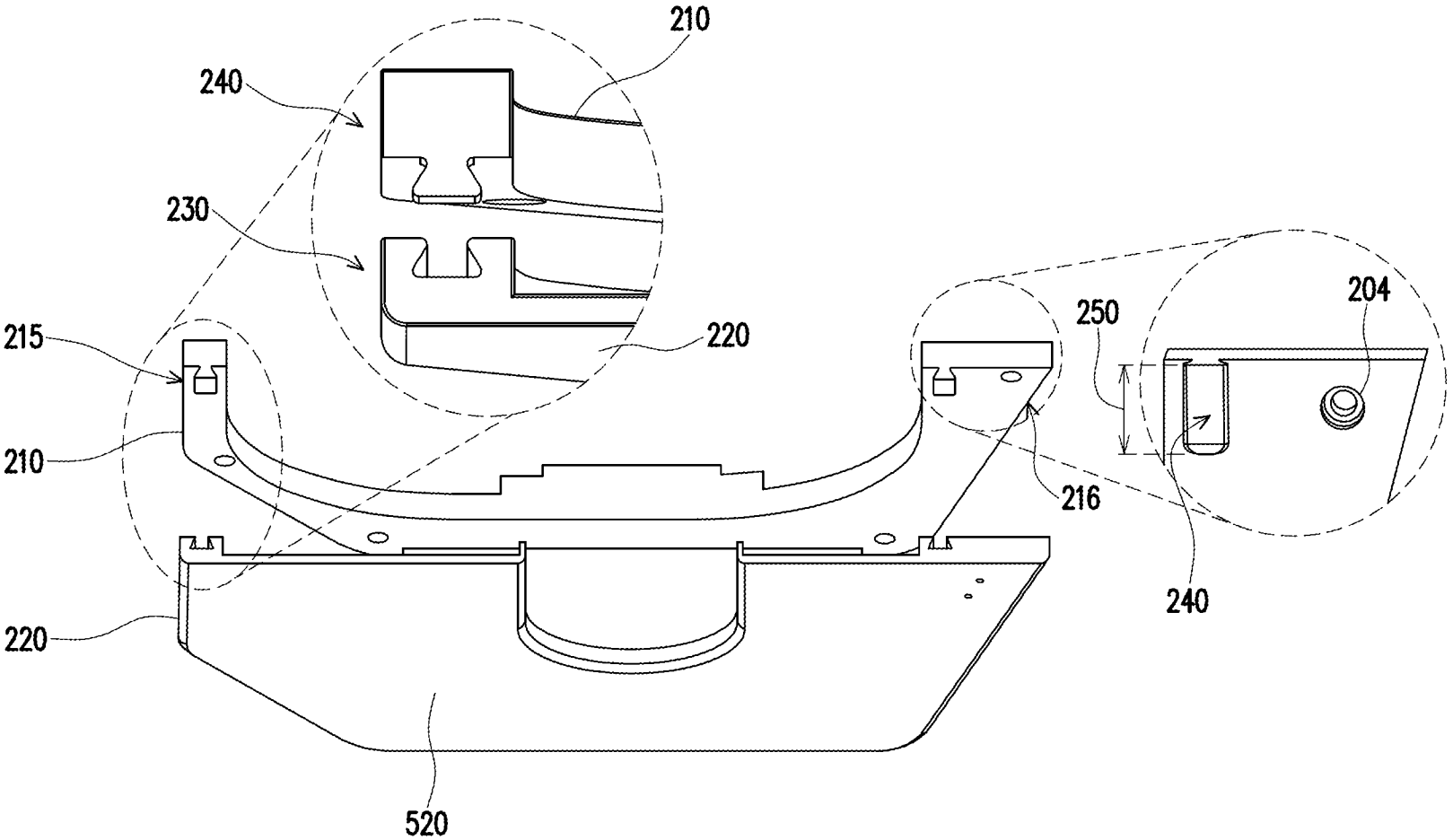
FIG. 4 is an enlarged view of a dovetail portion of an upper tray and a lower tray according to one embodiment of the present disclosure.

FIG. 4 is an enlarged view of a dovetail portion of an upper tray 210 and a lower tray 220 according to one embodiment of the present disclosure. As shown in FIG. 4, the upper tray 210 includes a first joint part, e.g., a protruded upper dovetail portion 240 and the lower tray 220 includes a second joint part, e.g., recessed lower dovetail portion 230. However, in other embodiments, the upper tray 210 may have recessed dovetail shape and the lower tray 220 may have a protruded dovetail shape and may vary depending on the manufacturing process or the design needs. The upper dovetail portion 240 is formed at both ends of arms 215, 216 of a U-shaped or a C-shaped upper tray 210. The lower dovetail portion 230 may be formed at corresponding locations of the lower tray 220 to receive the upper dovetail portion 240 when upper tray 210 is mated with lower tray 220. The upper dovetail portion 240 may extend along an arm 215 of the upper tray 210 and the upper dovetail portion 240 on the opposite side may extend to the same length along an arm 216 of the upper tray 210. However, according to various design needs and to ensure a secure fit between the upper tray 210 and the lower tray 220, the length of the dovetail portion in each arm can be formed at different lengths. That is, the length 250 of the dovetail portion may be any suitable length to ensure that the upper tray 210 and the lower tray 220 can smoothly slide and interlock with each other without having to use any fasteners (e.g., screws, nuts, and bolts, etc.) along the arm portion 215, 216 of the tray assembly 102.

In one embodiment, the upper dovetail portion 240 is of the same material as the upper tray 210. The upper dovetail portion 240 can be formed by forming a portion of the upper tray 210 so that the upper dovetail portion 240 extends toward the lower tray 220. In another embodiment, the upper dovetail portion 240 can be formed using a different material from the upper tray 210. For example, a different metal or alloy from the upper tray 210 can be used to form the dovetail portion and be attached (either removably or permanently) to the upper tray 210. Similarly, the lower dovetail portion 230 can be formed of the same material as the lower tray 220. The lower dovetail portion 230 can be formed by forming a recess portion having a corresponding complimentary shape to the upper dovetail portion 240 so that the upper dovetail portion 240 and lower dovetail portion 230 can interlock with each other. In another embodiment, the lower dovetail portion 230 can be formed using a different material from the lower tray 220 similar to that of the upper dovetail portion 240.

Figure 5:
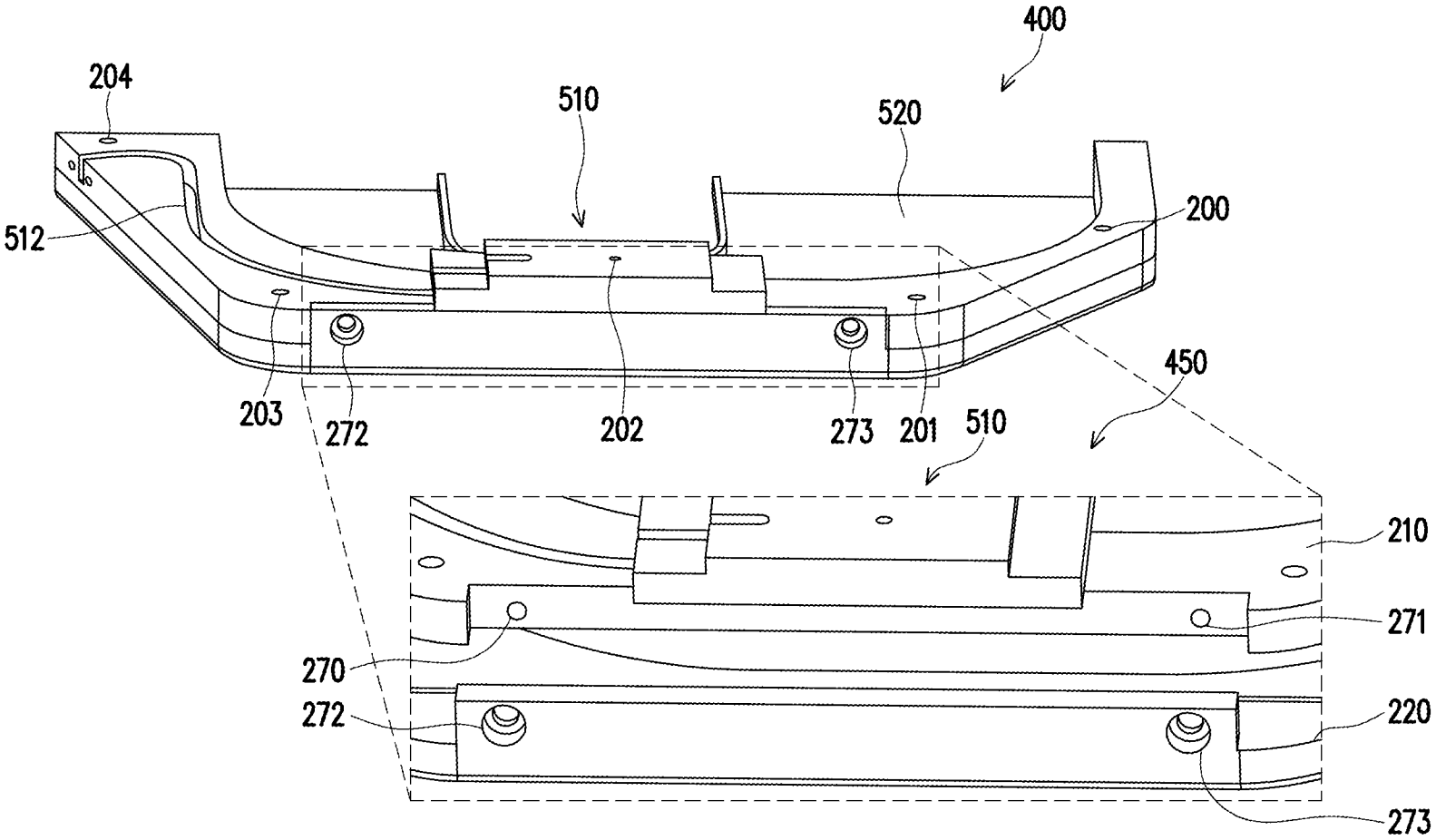
FIG. 5 is a perspective view of an opposite side of the tray assembly illustrated in FIG. 4 in an attached state and a detached state according to embodiments of the present disclosure.

FIG. 5 is a perspective view 400 of a side of a tray assembly 102, opposite to the side illustrated in FIG. 4, in an attached state according to embodiments of the present disclosure. As shown in FIG. 5, the tray assembly 102 includes a sensor circuit board 510, holes 270, 271 in the upper tray 210 (see view 450), and holes 272, 273 in the lower tray 220. The upper tray 210 of the tray assembly 102 includes a receptacle, e.g., a groove 512 which receives wiring connecting the sensor 232 (not shown in FIG. 5; see FIG. 3A) to the sensor circuit board 510. A wiring, cable, or any suitable electrically connecting structure placed in the groove 512 establishes an electrical or optical connection between the sensor 232 and the sensor circuit board 510.

The sensor circuit board 510 processes the sensed data from the sensor 232. The sensed data includes information such as color information of the polishing pad 120 and the workpiece 160, distance information from the sensor 232 to the polishing pad 120 and the workpiece 160, and any other suitable measurement information for determining appropriate alignment and attachment of the workpiece 160 to the polishing pad 120. The sensor circuit board 510 may include a microprocessor, or any suitable electronic circuitry capable of processing sensor data to determine appropriate alignment and attachment of the workpiece 160 and the polishing pad 120. The sensor circuit board 510 may be connected to other electronic circuitry components of the CMP system 100 to deliver and process the sensed data. In one or more embodiments, the sensor circuit board 510 is on the upper tray 210. Accordingly, in accordance with embodiments of the present disclosure, the sensor circuit board 510 along with other components (e.g., sensor 232) of the upper tray 210 need not be removed from the upper tray 210 during the cleaning process of the lower tray 220 which will significantly reduce the time required to complete the cleaning process.

FIG. 5 further shows a perspective view 450 of side of a tray assembly 102, opposite to the side illustrated in FIG. 4, in a detached state according to embodiments of the present disclosure.

In accordance with the embodiment of the present disclosure illustrated in FIG. 5, when the lower tray 220 is mated with the upper tray 210 by sliding the upper dovetail portion 240 into the lower dovetail portion 230, the lower tray 220 and the upper tray 210 are further fastened together using a fastener in the holes of the upper and lower tray. In order to provide a space for such fasteners, the upper tray 210 has holes 270, 271 provided adjacent to the sensor circuit board 510 and the lower tray 220 has holes 272, 273 at locations that correspond to the location of holes 270, 271 when upper tray 210 is mated with lower tray 220. Holes 270, 271 of the upper tray may be positioned at any suitable location adjacent to the sensor circuit board 510 that is convenient for a user to remove fasteners from the holes and disassemble and assemble the tray assembly 102. For example, as shown in FIGS. 1B and 2A, the tray portion 170 of the related art is attached to a rotating mechanism (e.g., carousel) located at the central body portion 180. Accordingly, it is convenient and efficient for the user to remove the fasteners from the side of the tray assembly 102 where the sensor circuit board 510 is located. In other words, by removing the fasteners from the holes 272, 273 and sliding the lower tray 220 out from under the upper tray 210 in a direction away from the rotating mechanism, provides less time consuming way of disassembling, reassembling the lower tray 220 compared to if the entire tray assembly must be removed from other portions of the CMP system and the sensor removed from the tray assembly. As an example, because the tray assembly 102 according to embodiments of the present disclosure utilizes fewer number of fasteners (e.g., 2 fasteners) compared to the tray 104 from the related art (e.g., 8 fasteners), the disassembling, cleaning, and reassembling process can be completed in less than about 10 minutes. To elaborate, for the tray assembly 102 in accordance with embodiments of the present disclosure, the number of fasteners that need to be removed in order to separate the upper tray and the lower tray is two (e.g., one fastener at hole 272, and the other fastener at hole 273). On the other hand, the tray 104 of the related art, includes eight fasteners that need to be removed in order to clean the tray assembly. Referring to FIG. 2B, firstly, in order for the tray 104 to be cleaned, the entire tray 104 needs to be detached from the CMP system. Accordingly, the 6 fasteners in the holes used to fasten the tray 104 to the CMP system (e.g., holes 190, 191, 192, 193, 194, 195) need to be removed. The sensor 180 also needs to be removed from the tray 104 in order not to damage the sensor 180 during the cleaning process. Accordingly, the two fasteners in the holes used to fasten the sensor 180 to the tray 104 (e.g., holes 196, 197) need to be removed. Since the tray assembly 104 of the related art includes four tray portions 170 which are connected to the central body portion 180, the total number of fasteners that have to be removed is 32 fasteners: 8 (number of fasteners in one tray)×4 (number of tray assemblies associated with one carousel). On the other hand, the tray assembly 102 according to embodiments of the present disclosure has 8 fasteners that have to be removed for the cleaning process: 2 (number of fasteners in one tray assembly)×4 (number of tray assemblies associated with one carousel). Accordingly, the tray assembly 102 according to an embodiment of the present disclosure can be disassembled for cleaning and reassembled in a significantly less amount of time compared to the tray assembly 104 of the related art. For example, the amount of time required to disassemble, clean and reassemble a tray assembly formed in accordance with embodiments of the present disclosure can be reduced by about 80% to 90% (e.g., the time can be reduced from 120 mins to 10 mins) compared to the time required to disassemble, clean and reassemble a tray assembly of the related art.

In one or more embodiments, the fasteners used to attach the lower tray 220 to the upper tray 210 include any suitable means for reversibly coupling the lower tray 220 to the upper tray 210. In addition, the fasteners can assist in preventing infiltration of any particles, debris, slurries, and DIW between the lower tray 220 and the upper tray 210. The fasteners, for example, include a hardware device that mechanically joins or affixes two or more objects together. These fasteners can be removed or dismantled without damaging the components that are being affixed to each other. In one example, the fasteners can include bolts, screws, clips, pins, or the like. In other examples, the fasteners do not necessarily have to have hardware, mechanical characteristics. That is, synthetic rubbers, or plastics or any other material that is capable of reversibly fixing the lower tray 220 to the upper tray 210 can be used. In another embodiment, the fasteners include a device that electromagnetically or magnetically joins or affixes two or more objects together. For example, the fasteners can include magnets or the like. In one embodiment of the present disclosure, the holes 270, 271 and the corresponding holes 272, 273 and fasteners in such holes can be replaced with a device capable of magnetic coupling. For example, a plurality of magnets can be used in place of the holes 270, 271 and fasteners at corresponding locations from holes 272, 273 of the lower tray 220 to form a magnetic coupling between the upper tray 210 and the lower tray 220.

Figure 6:
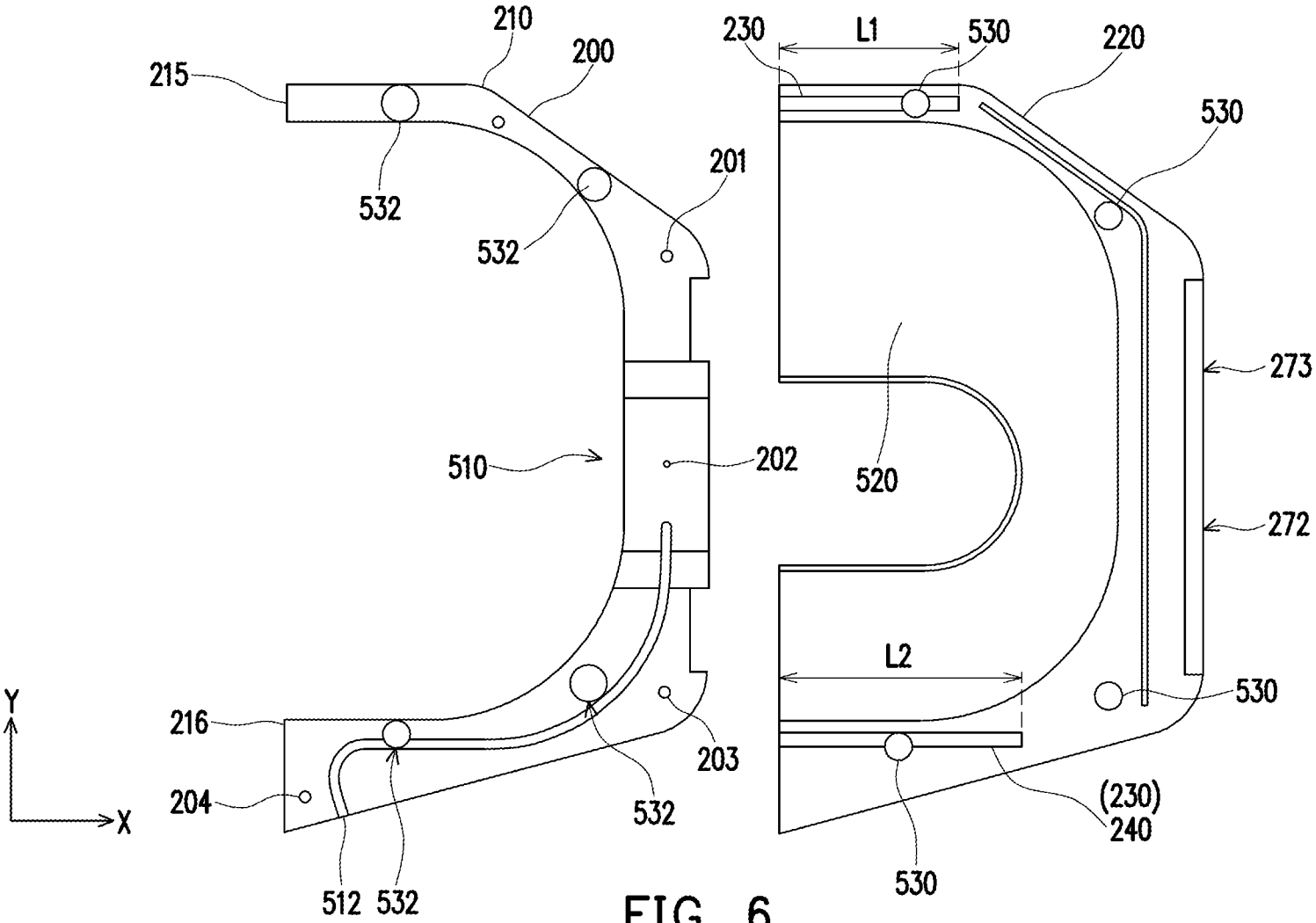
FIG. 6 is a top view of a tray assembly having magnets according to embodiments of the present disclosure.

FIG. 6 is a top view of a tray assembly 102 having magnets 530, 532 according to embodiments of the present disclosure. When a magnet 530 overlaps a magnet 532 a magnetic joint is formed. As shown in FIG. 6, a plurality of magnetic joints are formed by pairs of magnets 530, 532 located along the arm portions 215, 216 of the upper tray 210 and the corresponding locations on the lower tray 220. The magnets 532 located on the upper tray 210 may have an opposite polarity from the magnets 530 located on the lower tray 220. The magnets 532 may be located in numerous locations along the arm portions 215, 216. The locations of the magnetic joints (or magnets) are selected so as to provide a secure attachment between the upper tray 210 and lower tray 220. For example, the magnets 532 ensure a secure fit that does not create a substantial seam, gap, or space between the upper tray 210 and the lower tray 220.

In one embodiment, the magnets 532 are evenly spaced along the upper tray 210 and in the corresponding locations of the lower tray 220 (e.g., magnets 530). By maintaining an even distance between the adjacent magnets 532 the magnetic force applied between the upper and lower trays 210, 220 are evenly distributed. Although not shown in FIG. 6, an additional magnetic joint can be placed adjacent to the sensor circuit board 510. In other words, the additional magnetic joint can be used in lieu of the fasteners used at holes 272, 273.

In another embodiment, the magnets 532 are evenly spaced along the arm portion 215 and the opposite arm portion 216 in the upper tray 210, and a mechanical fastener (e.g., screws, bolts, etc.) is used at holes 272, 273 in conjunction with the magnets 532. In this embodiment, additional or alternative magnets 532 may not be required as the mechanical fastener fixates the upper and lower trays 210, 220 at the location near the sensor circuit board 510.

In one or more embodiments, at least one of the magnets 530, 532 may overlap with locations of the upper and lower dovetail joint 240, 230. For example, one magnet 530 may be placed along the location of the lower dovetail joint 230, and the corresponding magnets 532 may be placed along the location of the upper dovetail joint 240. By overlapping the location of the magnetic joint with the dovetail joint, upper tray 210 and the lower tray 220 can be attached firmly. For example, by using both dovetail joint and the magnetic joint, the tray assembly 102 can reduce or minimize any movement along the direction of the X-axis as well as any movement along the direction of the Y-axis.

In one or more embodiments, a length $L_1$ of the lower dovetail joint 230 extending from one end of the arm portion 215 may be different from a length $L_2$ of the lower dovetail joint 230 extending from one end of the arm portion 216. However, in some embodiments, the length of $L_1$ and $L_2$ can be the same as explained previously. The corresponding length of the upper dovetail joint 240 may be substantially identical to the length of the lower dovetail joint 230. The length of the dovetail joint can vary based on the design of the tray or any other needs during the manufacturing process. In some embodiments, as the length of the dovetail joint extends closer to the sensor circuit board 510, the number of fasteners or magnetic joints required between the dovetail joint and the sensor circuit board 510 may be reduced.

Figure 7:
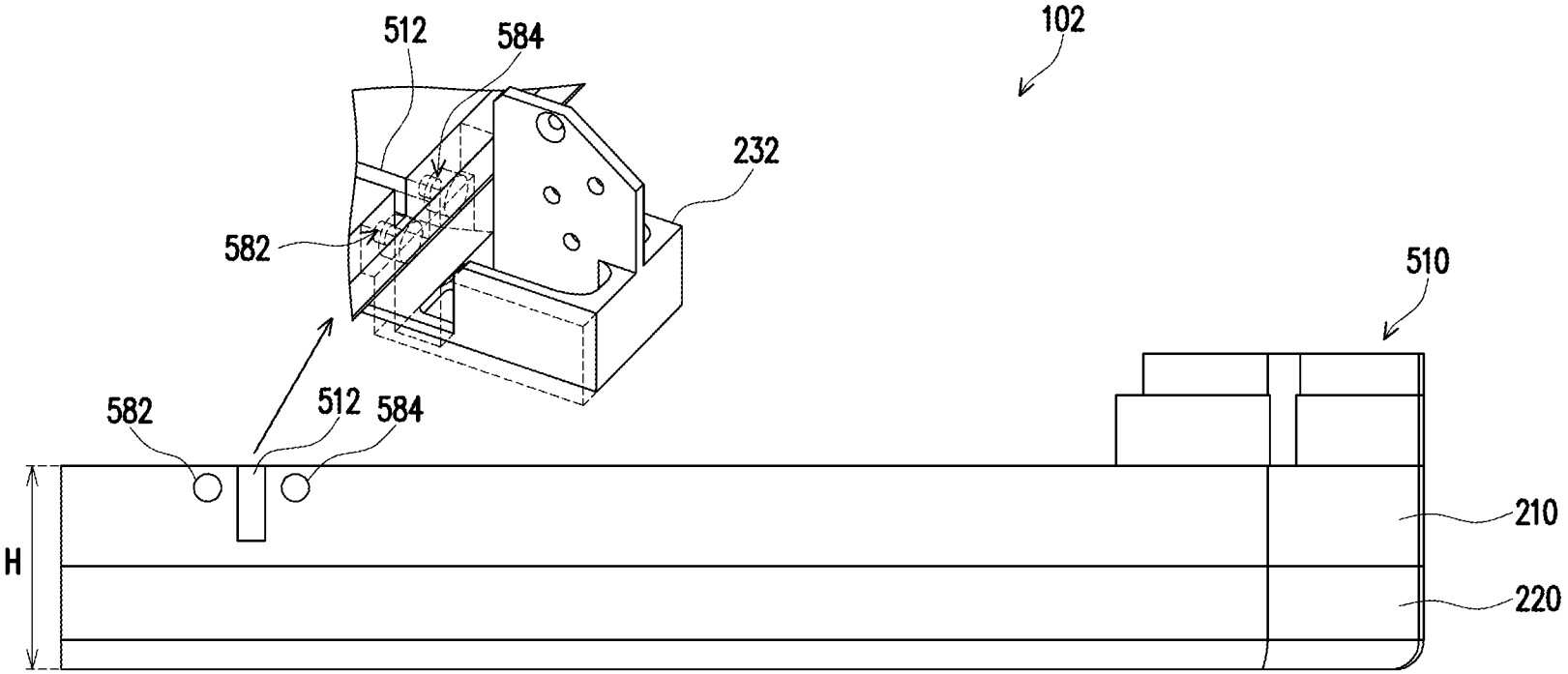
FIG. 7 is a cross-sectional view of a tray assembly showing overall height/thickness of the assembly according to embodiments of the present disclosure.

FIG. 7 is a cross-sectional view of a tray assembly 102 showing overall height/thickness of the assembly according to embodiments of the present disclosure. In FIG. 7, holes 582, 584 for receiving fasteners to affix the sensor 232 to upper tray 210 are provided in a sidewall of the upper tray 210. The groove 512 for the wiring to connect the sensor 232 with the sensor circuit board 510 is between the first hole 582 and the second hole 584. In some embodiments, the combined height H of the upper tray 210 and the lower tray 220 when mated with each other is less than about 30 mm. In other embodiments the combined height H of the upper tray 210 and the lower tray 220 is less than about 25 mm. In other embodiments the combined height H is less than about 21 mm and in other embodiments the combined height is less than 20.5 mm. In other embodiments, the combined height of the upper tray 210 and the lower tray 220 is greater than 30 mm, greater than 21 mm or greater than 20.5 mm.

Figure 8:
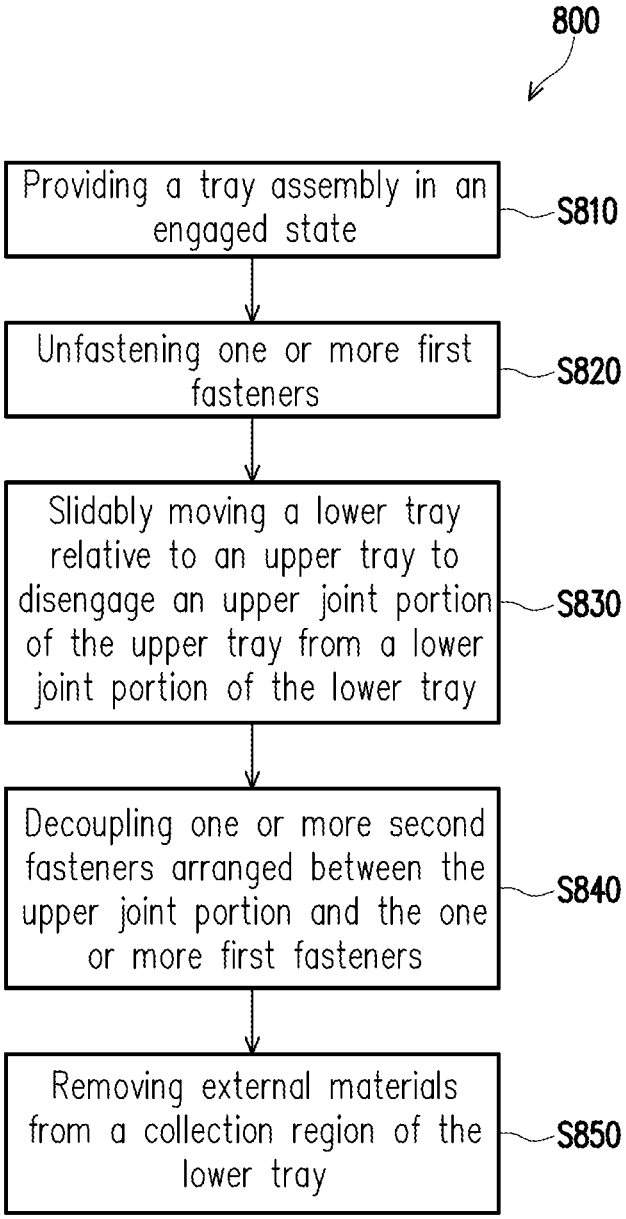
FIG. 8 is a flow chart of steps of a method of cleaning a tray assembly in accordance with embodiments of the present disclosure.

FIG. 8 is a flow chart 800 of steps of a method of cleaning a tray assembly in accordance with embodiments of the present disclosure.

First at step S810, a tray assembly is provided at an engaged state. The engaged state refers to the state where the lower tray and the upper tray of the tray assembly is locked in with each other. At step S820, one or more first fasteners are unfastened. At step S830, the lower tray is slidably moved relative to the upper tray to disengage an upper joint portion of the upper try from a lower joint portion of the lower tray. At step S840, one or more second fasteners arranged between the upper joint portion and the one or more first fasteners are decoupled. After step S840, the lower tray having a collection region is disengaged from the upper tray. Then at step S850, the external material from the collection region of the lower tray is removed. After the removal and the cleaning process are completed, the lower tray may be engaged back to the upper tray to form the tray assembly.

The removable tray assembly according to the present disclosure can be quickly and easily disassembled and reassembled. The removable tray assembly includes an upper tray and a lower tray. For cleaning, only the lower tray is detached from the CMP system and removed for cleaning. The lower tray includes a collection region where foreign and external materials (e.g., metal particles, debris, slurry, DIW, or any other materials) that could damage the sensitive components of the workpiece under process are collected. During the cleaning process, the lower tray is removed from the CMP system and the materials collected in the collection region of the lower tray are separated from the lower tray. After the cleaning of the lower tray is completed, the lower tray can be quickly and easily reassembled with the upper tray of the tray assembly and placed back into operation. The removable tray assembly of the present disclosure includes a dual-tray structure and a number or type of fasteners that can be disengaged more quickly compared to the time required to disengage fasteners used on tray assembly of the related art. With the removable tray assembly according to the present disclosure, the time involved in disassembling, cleaning, and reassembling the tray can be reduced by more than 80 to 90% compared to the tray assembly in the related art. Further aspects of the present disclosure include a tray assembly that includes a dovetail joint. The male and female portions of the dovetail joint on the upper tray and corresponding location of the lower tray supports the quick and easy detachment and reattachment of the lower tray to the upper tray. That is, the dovetail joint allows the lower tray to be easily slide into place and placed into the proper position relative to the upper tray. A further aspect of the present disclosure relates to the use of magnetic joints to assist in securing the upper tray to the lower tray. The magnetic joints are configured to provide additional attaching force (e.g., magnetic force, magnetic coupling) between the upper tray and the lower tray on top of the dovetail joint. The magnetic joints are also positioned to provide attraction force at locations where other fasteners (e.g., mechanical fasteners used to fasten the upper tray and the lower tray at the location near the sensor circuit board) and the dovetail joint are not able to do so. By using fewer mechanical fasteners than those used on tray assemblies of the related art, the overall time required to complete a cleaning process of a tray assembly formed in accordance with embodiments of the present disclosure is reduced a significant amount. Such reduction in time for maintenance or repair or cleaning translates into a lower cost of manufacturing and increase in yield efficiency.

One aspect of the present disclosure is a tray assembly for a chemical mechanical polishing system. The tray assembly includes: a first tray having a first joint part; a second tray having a second joint part, the first joint part and the second joint, in operation, cooperating with each other to reversibly attach the second tray to the first tray, the second tray including a collection region; and a plurality of first fasteners positioned at selected locations of the first tray and which, in operation, secures the first tray to the second tray, at least one of the plurality of first fasteners positioned adjacent to the first joint part of the first tray.

In one embodiment, the first tray is a U-shaped tray and the second tray has a corresponding U-shape, wherein the collection region is U-shaped, wherein the first joint part is a male dovetail and the second joint part is a female dovetail, and the first joint part extends to a selected length from an end of an arm of the U-shaped first tray, and the second joint part extends to the selected length from an end of an arm of the U-shaped second tray.

In one embodiment, the plurality of first fasteners includes magnets which are spaced apart from each other.

In one embodiment, at least one of the magnets is arranged on the first joint part.

In one embodiment, the tray assembly further includes: a sensor circuit board included at a first portion of the first tray; and a sensor electrically connected to the sensor circuit board, the sensor removably attached to a second portion of the first tray, wherein the first portion is spaced apart from the second portion of the first tray.

In one embodiment, the first portion is a center portion between arm portions of the U-shaped first tray and the second portion is an arm portion of the U-shaped first tray.

In one embodiment, the tray assembly further includes: a plurality of second fasteners positioned adjacent to the first portion of the first tray.

In one embodiment, the plurality of second fasteners includes a mechanical fastener attaching the first tray to the second tray.

In one embodiment, the plurality of second fasteners are located adjacent to one end of the sensor circuit board and another end of the sensor circuit board, the plurality of second fasteners including a screw.

In one embodiment, a thickness of the first tray and the second tray assembled together is less than about 25 mm.

Another aspect of the present disclosure is a method of cleaning a tray assembly of a CMP system. The method includes the steps of: providing the tray assembly including an upper tray and a lower tray in an engaged state, the upper tray and the lower tray attached to each other by one or more first fasteners and by an upper joint portion of the upper tray and a lower joint portion of the lower tray, the upper tray including a collection region; unfastening the one or more first fasteners; slidably moving the lower tray relative to the upper tray to disengage the upper joint portion of the upper tray from the lower joint portion of the lower tray; decoupling one or more second fasteners arranged between the upper joint portion and the one or more first fasteners, the one or more second fasteners each including a component located on the upper tray and a component located on the lower tray; and removing external materials from the collection region of the lower tray.

In one embodiment, the engaged state includes the upper joint portion of the upper tray and the lower joint portion of the lower tray interlocked with each other.

In one embodiment, the first fasteners include a mechanical fastener and the components of the second fasteners include a magnet.

In one embodiment, the step of decoupling one or more second fasteners arranged between the upper joint portion and the one or more first fasteners includes: the steps of applying a lateral force along a direction of the sliding; and separating the magnets of the one or more second fasteners in response to the lateral force being greater than a magnetic force between the magnets of the second fasteners.

Another aspect of the present disclosure is a chemical mechanical polishing system. The CMP system includes: a head connected to a carousel of the CMP system; a plurality of tray assemblies located below the head; a center tray having a plurality of arm portions equal to a number of the plurality of tray assemblies, each arm portion connected to a tray assembly; each tray assembly of the plurality of tray assemblies including: a dovetail joint including a first joint part and a second joint part that interlocks with the first joint part; a first tray having the first joint part; a second tray having the second joint part, the first joint part with the second joint part being mateable with each other, the second tray being attached to the first tray when the first joint part is mated with the second joint part; and a plurality of fasteners positioned at selected locations of the first tray and the second tray, wherein at least one of the plurality of fastener is positioned adjacent to the first joint part of the first tray.

In one embodiment, the plurality of fasteners include magnets which are spaced apart from each other.

In one embodiment, the first joint part of the dovetail joint extends a selected length along the first tray and the second joint part of the dovetail joint extends the selected length along the second tray.

In one embodiment, at least one of the magnets overlies the first joint part and the second joint part of the dovetail joint.

In one embodiment, the tray assembly further includes: a sensor circuit board positioned at a first portion of the first tray; and a sensor electrically connected to the sensor circuit board, the sensor being removably attached to a second portion of the first tray, wherein the first portion is spaced apart from the second portion of the first tray.

In one embodiment, the first portion is a center portion of a U-shaped first tray and the second portion is one end of an arm of the U-shaped first tray.

In one embodiment, the chemical mechanical polishing system further includes: at least one second fastener positioned adjacent to the first portion of the first tray and at corresponding locations of the second tray, wherein the at least one second fastener is a mechanical fastener including a screw attaching the first tray to the second tray.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A tray assembly for a polishing head in a chemical mechanical polishing (CMP) system, comprising:

a first tray having a first top surface and a first bottom surface opposite the first top surface, the first tray having a first joint part on the first bottom surface;

a second tray having a second top surface and a second bottom surface opposite the second top surface, the second top surface of the second tray facing the first bottom surface of the first tray, the second tray having a second joint part on the second top surface, the first joint part and the second joint part, in operation, cooperating with each other to reversibly attach the second tray to the first tray, the second tray including a collection region; and a plurality of first fasteners positioned at selected locations of the first tray and which, in operation, secures the first tray to the second tray, at least one of the plurality of first fasteners positioned adjacent to the first joint part of the first tray, wherein the first joint part is a male dovetail and the second joint part is a female dovetail, and wherein, in operation, the male dovetail of the first tray slidably inserts into the female dovetail of the second tray to secure the first tray to the second tray.

2. The tray assembly of claim 1, wherein the first tray is a U-shaped tray and the second tray has a corresponding U-shape, wherein the collection region is U-shaped, wherein the first joint part extends to a selected length from an end of an arm of the U-shaped first tray, and the second joint part extends to the selected length from an end of an arm of the U-shaped second tray.

3. The tray assembly of claim 2, wherein the plurality of first fasteners includes magnets which are spaced apart from each other.

4. The tray assembly of claim 3, wherein at least one of the magnets is arranged on the first joint part.

5. The tray assembly of claim 3, further comprising:

a sensor circuit board included at a first portion of the first tray; and a sensor electrically connected to the sensor circuit board, the sensor removably attached to a second portion of the first tray, wherein the first portion is spaced apart from the second portion of the first tray.

6. The tray assembly of claim 5, wherein the first portion is a center portion between arm portions of the U-shaped first tray and the second portion is an arm portion of the U-shaped first tray.

7. The tray assembly of claim 6, further comprising:

a plurality of second fasteners positioned adjacent to the first portion of the first tray.

8. The tray assembly of claim 7, wherein the plurality of second fasteners include a mechanical fastener attaching the first tray to the second tray.

9. The tray assembly of claim 8, wherein the plurality of second fasteners are located adjacent to one end of the sensor circuit board and another end of the sensor circuit board, the plurality of second fasteners including a screw.

10. The tray assembly of claim 1, wherein a thickness of the first tray and the second tray assembled together is less than about 25 mm.

11. A method of using a tray assembly of a chemical mechanical polishing (CMP) system, the method comprising, providing a first tray having a first top surface and a first bottom surface opposite the first top surface, the first tray having a first joint part on the first bottom surface;

providing a second tray having a second top surface and a second bottom surface opposite the second top surface, the second top surface of the second tray facing the first bottom surface of the first tray, the second tray having a second joint part on the second top surface, the second tray including a collection region;

reversibly attaching the second tray to the first tray by slidably inserting the first joint part of the first tray into the second joint part of the second tray such that the first and second joint parts cooperate with each other to secure the first tray to the second tray;

providing a plurality of first fasteners positioned at selected locations of the first tray; and securing the first tray to the second tray using the plurality of first fasteners, at least one of the plurality of first fasteners positioned adjacent to the first joint part of the first tray, the first joint part being a male dovetail and the second joint part being a female dovetail.

12. The method of claim 11, comprising:

interlocking the first joint part of the upper tray and the second joint part of the lower tray to each other.

13. The method of claim 11, comprising:

providing a plurality of second fasteners positioned adjacent to the first tray, wherein the first fasteners include a mechanical fastener and the components of the second fasteners include a magnet.

14. The method of claim 13, comprising: decoupling the plurality of first fasteners includes:

applying a lateral force along a direction of the sliding; and separating the magnets of the one or more second fasteners in response to the lateral force being greater than a magnetic force between the magnets of the second fasteners.

15. A chemical mechanical polishing (CMP) system, comprising:

a head connected to a carousel of the CMP system;

a plurality of tray assemblies located below the head;

a center tray having a plurality of arm portions equal to a number of the plurality of tray assemblies, each arm portion connected to a tray assembly;

each tray assembly of the plurality of tray assemblies including:

a dovetail joint including a first joint part and a second joint part that interlocks with the first joint part;

a first tray having a first top surface and a first bottom surface opposite the first top surface, the first tray having the first joint part on the first bottom surface;

a second tray having a second top surface and a second bottom surface opposite the second top surface, the second top surface of the second tray facing the first bottom surface of the first tray, the second tray having the second joint part on the second top surface, the first joint part with the second joint part being mateable with each other, the second tray being attached to the first tray when the first joint part is mated with the second joint part; and a plurality of fasteners positioned at selected locations of the first tray and the second tray, wherein at least one of the plurality of fastener is positioned adjacent to the first joint part of the first tray, wherein the first joint part is a female dovetail and the second joint part is a male dovetail, and wherein, in operation, the male dovetail of the second tray slidably inserts into the female dovetail of the first tray to secure the first tray to the second tray.

16. The chemical mechanical polishing system of claim 15, wherein the plurality of fasteners include magnets which are spaced apart from each other.

17. The chemical mechanical polishing system of claim 16, wherein the first joint part of the dovetail joint extends a selected length along the first tray and the second joint part of the dovetail joint extends the selected length along the second tray.

18. The chemical mechanical polishing system of claim 17, wherein at least one of the magnets overlies the first joint part and the second joint part of the dovetail joint.

19. The chemical mechanical polishing system of claim 18, the tray assembly further comprising:

a sensor circuit board positioned at a first portion of the first tray; and a sensor electrically connected to the sensor circuit board, the sensor being removably attached to a second portion of the first tray, wherein the first portion is spaced apart from the second portion of the first tray.

20. The chemical mechanical polishing system of claim 19, wherein the first portion is a center portion of a U-shaped first tray and the second portion is one end of an arm of the U-shaped first tray, the chemical mechanical polishing system, further comprising:

at least one second fastener positioned adjacent to the first portion of the first tray and at corresponding locations of the second tray, wherein the at least one second fastener is a mechanical fastener including a screw attaching the first tray to the second tray.

* * * * *